US008413300B1

(12) United States Patent
Luneborg

(10) Patent No.: US 8,413,300 B1
(45) Date of Patent: Apr. 9, 2013

(54) GATE HINGE

(75) Inventor: John V. Luneborg, Hillsboro, OH (US)

(73) Assignee: Safety Hinge Productions, LLC, Hillsboro, OH (US)

( * ) Notice: Subject to any disclaimer, the term of this patent is extended or adjusted under 35 U.S.C. 154(b) by 478 days.

(21) Appl. No.: 12/660,390

(22) Filed: Feb. 25, 2010

(51) Int. Cl.
*E05D 5/02* (2006.01)

(52) U.S. Cl.
USPC ..... 16/253; 16/380

(58) Field of Classification Search ..... 16/252, 16/253, 298, 380, 76, 239, 307; 411/513–515, 411/439, 487, 489
See application file for complete search history.

(56) References Cited

U.S. PATENT DOCUMENTS 1,016,515 A * 2/1912 Nolte ..... 16/256
1,099,490 A * 6/1914 Crowley ..... 16/76
1,126,067 A * 1/1915 Nolte ..... 16/307
2,025,238 A * 12/1935 Harter ..... 16/298
2,172,868 A * 9/1939 Elson ..... 49/247
2,585,152 A * 2/1952 Merchant ..... 49/160
3,093,363 A * 6/1963 Bohon ..... 256/26
4,122,630 A * 10/1978 Parisien ..... 49/386
6,634,843 B1 * 10/2003 Tarnow et al. ..... 411/508
2003/0012621 A1 * 1/2003 Fletcher ..... 411/513

* cited by examiner

*Primary Examiner* — Roberta Delisle
(74) *Attorney, Agent, or Firm* — Neal O. Willmann

(57) ABSTRACT

A gate hinge to facilitate wide angular rotation between a gate and the fence post to which it is attached can be fabricated from a vertically oriented hinge pin having a transverse hole near the top of the pin and a threaded attachment pin affixed to the bottom of the hinge pin for secure attachment to the fence post. A hinge round adjustably attached to a vertical member of the gate and positioned to encircle the hinge pin provides support for the gate and permits the gate to swing and rotate about the hinge pin in a hinge-like fashion. The hinge pin and hinge round are securely mated by inserting a security pin, sized to fit, through the hole in the top of the hinge pin.

4 Claims, 3 Drawing Sheets

GATE HINGE

BACKGROUND OF THE INVENTION

This disclosure relates in general to a gate hinge assembly, and specifically, it relates to a gate hinge assembly having properties that make it affordable and easy to install.

BRIEF SUMMARY OF THE INVENTION

Disclosed and claimed herein is a gate hinge assembly specifically designed to accommodate the attachment of a gate to a fence post. The disclosed hinge, when installed, attaches to a vertical member of a gate and to a vertically aligned fence post. The claimed assembly comprises a hinge pin, vertically aligned and parallel with the gate member and the fence post and having a transverse hole in its distal or top end. Attached to the bottom of the hinge pin and extending horizontally, and at about a 90 degree angle from the pin, is a threaded attachment pin for semi-permanent attachment to the fence post. Affixed to a vertical member of the gate is a hinge round positioned to interact and encircle the hinge pin thus supporting the gate and permitting the gate to swing and rotate about the hinge pin in a hinge-like fashion. And, to maintain the engagement and interaction of the hinge pin and hinge round, a security pin is inserted through the distal hole in the hinge pin.

DETAILED DESCRIPTION OF THE INVENTION

Figure 1:
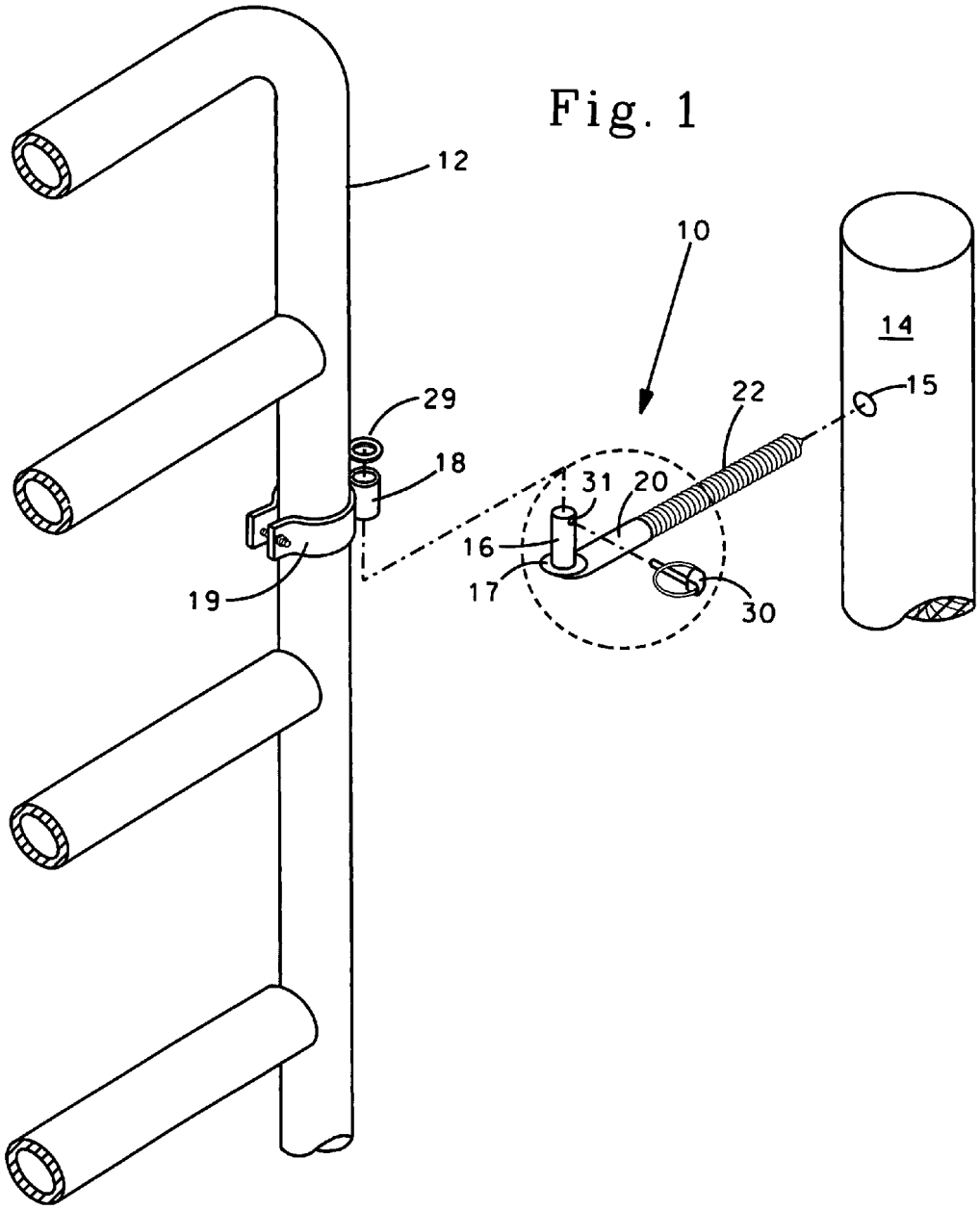
FIG. 1 illustrates all elements of the disclosed gate hinge assembly and depicts its relationship to a fence post and gate.

A thorough understanding of the disclosed invention is facilitated by referring to the drawing. FIG. 1 illustrates all the elements of the disclosed gate hinge assembly 10. When assembled correctly the gate hinge assembly 10 joins a fence post 14 with a vertically aligned member of a gate 12 to be attached to the fence. And, when assembled properly and in pairs, the gate hinge will attach the gate to the fence, support the gate and permit the gate to swing in a wide arc about and around the fixed fence post 14.

The elements of the gate hinge assembly 10 include the hinge pin 16, which is vertically aligned and permanently attached to a horizontally positioned threaded attachment pin 20. The hinge pin 16 projects vertically, at 90 degrees, from the attachment pin 20. The pins can be fabricated from the same material and bent or machined to form the preferred right-angled relationship, or the proximal end of the attachment pin can be welded to the bottom of the hinge pin to secure the orientation and relationship. In a preferred embodiment, a seat 17 can be welded or machined at the juncture of the hinge pin 16 and attachment pin 20 to accommodate the hinge round 18.

Referring still to FIG. 1, the threads 22 on the attachment pin 20 enable the secure attachment of the attachment pin 20 to the fence post 14. In FIG. 1, the attachment pin is depicted with wood-screw-type threads, which when screwed into a pre-drilled hole 15 in the fence post 14, will be self-securing, and no additional hardware is required. In fact, if the pre-drilled hole is large enough, the attachment pin can be hand-screwed into the fence post, especially if the assembler uses the hinge pin as a grip or lever. Hand-installation is, of course, one of several advantages of the disclosed hinge assembly.

Figure 2:
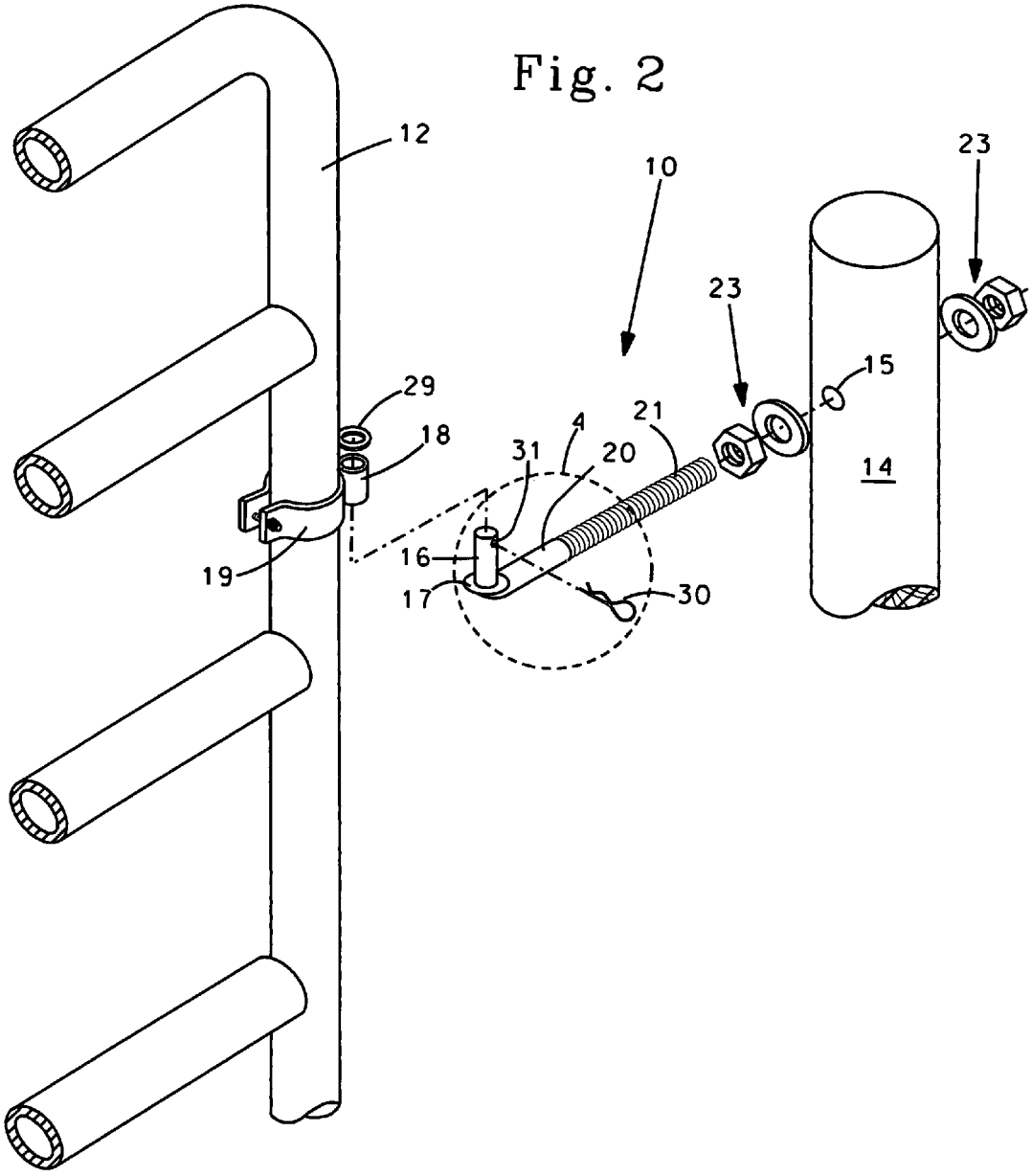
FIG. 2 is essentially the same illustration as FIG. 1 but depicting an attachment pin secured with machined fasteners.
Figure 3:
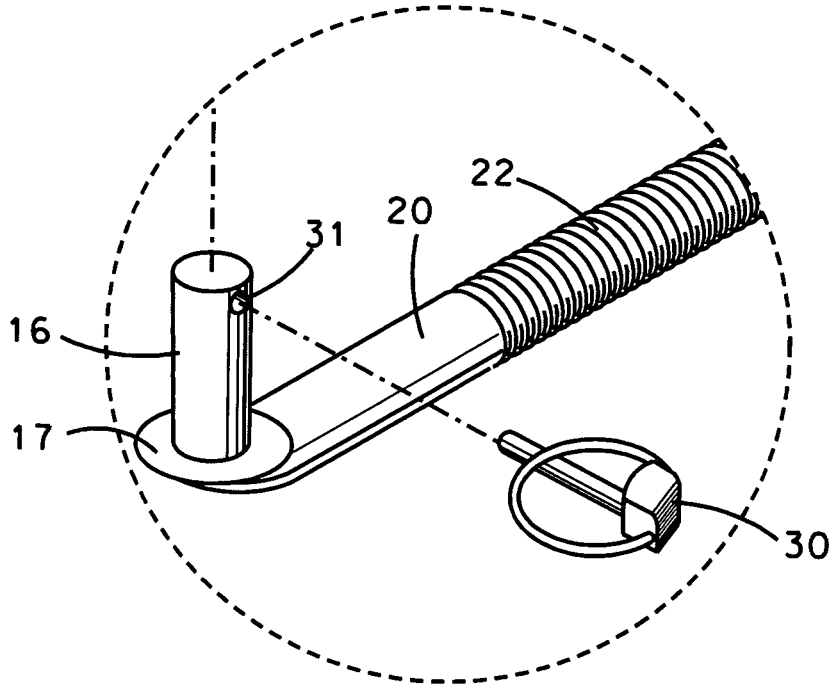
FIG. 3 illustrates an isolated view of one means of employing a security pin to maintain the hinge pin within the hinge round, specifically, with a linchpin.
Figure 4:
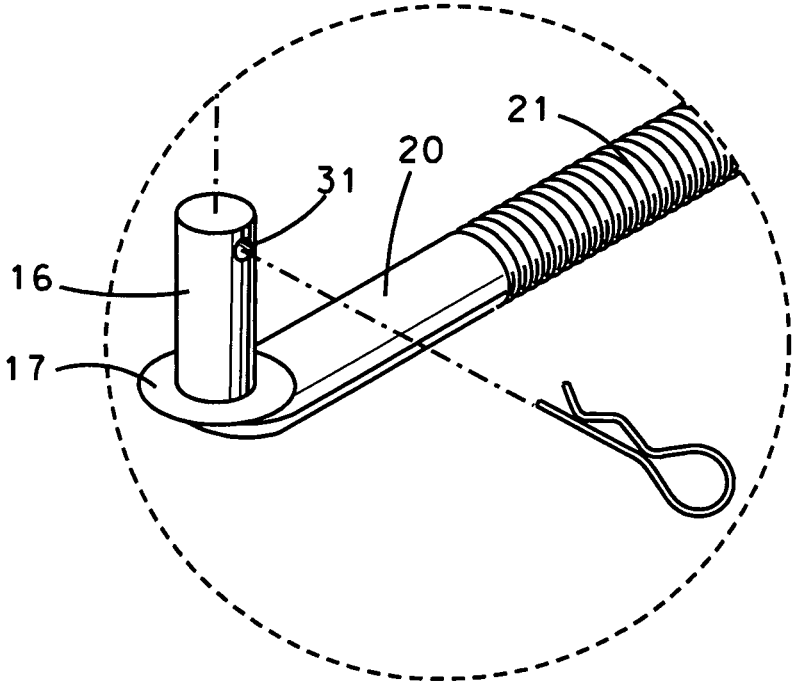
FIG. 4 illustrates a second means of securing the hinge pin within the hinge round, specifically, with a cotter key.

An alternative embodiment of the attachment pin 20 is depicted in FIG. 2. In this embodiment, the threads 21 are machined to accommodate machined fasteners 23. Of course, using this method of attachment, a pre-drilled hole 15 larger than the diameter of the threaded attachment pin 20, is required. The method of securing the attachment pin 20 to the fence post 14 is not critical to the effectiveness of the disclosed gate hinge assembly 10. Either of the disclosed methods of attachment is acceptable and both are within the skills of the farm or ranch owner. The only requirement is that the attachment pin be threaded.

During the process of attaching the attachment pin 20 to the fence post 14, the attachment pin will need to be secured to the post so that the hinge pin 16 is vertically aligned with the fence post 14. The hinge round 18 is then affixed to a vertical member of the gate 12. Preferably, the hinge round 18 is permanently affixed to a flexible attachment strap or band 19, which can accommodate the circumference of the vertical gate member so that it can be adjustably affixed to the gate and appropriately positioned and tightened. Proper positioning entails only that the hinge round 18 be aligned so as to accommodate the insertion of the hinge pin. When properly aligned, the hinge pin 16 will fit neatly within the hinge round 18 and extend slightly above the round 18 so that a transverse hole 31 in the pin near the top of the pin is not covered or concealed by the hinge round. The hole is appropriately sized so that it will permit the insertion of a security pin or key 30 to secure the confinement of the hinge pin within the hinge round. The specific nature and particulars of the security key 30 are not critical. Currently, either a linchpin or cotter key works equally well. If space permits, a washer 29 can be placed over the tip of the pin before inserting the pin or key 30 to provide a seat for the pin 30, but the use of a washer is a modest refinement that may or may not be necessary. The ideal hinge round is a cylinder having an inside diameter large enough to accommodate the hinge pin and permit the free swing or rotation of the gate about the hinge pin 16. Seat 17, at the juncture of the hinge pin and attachment pin will facilitate the axial rotation of the hinge round about the hinge pin.

The elements of the disclosed gate hinge assembly can easily be fabricated from a variety of sturdy and enduring materials. As a practical matter, a variety of modestly priced steel materials can be machined, tooled and formed to provide suitable pins and rounds and attachment straps or bands according to the described invention.

While the foregoing is a detailed and complete description of the preferred embodiments of the disclosed gate hinge assembly, it should be apparent that numerous variations and modifications can be made and employed to implement the all important purpose of the disclosed hinge without departing from the spirit of the invention, which is fairly defined by the appended claims.

The invention claimed is:

1. A hinge assembly for accommodating a gate in a fence said gate having a vertical member aligned with a vertical post in said fence, said hinge assembly comprising:

a hinge pin having a top and bottom and vertically oriented and parallel with said gate member and said fence post, and having a transverse hole near the top end of said hinge pin;

a horizontal attachment pin, permanently attached to said bottom of said hinge pin, having a threaded distal end for semi-permanent attachment to said fence post;

a hinge round affixed to the vertical member of said gate and positioned to encircle said hinge pin and support said gate on said hinge pin and permit said gate to swing and rotate about said hinge pin in a hinge-like fashion; and, a security pin sized to fit through said transverse hole in said hinge pin thereby securing said hinge pin within said hinge round after insertion of said hinge pin into said hinge round.

2. The hinge assembly according to claim 1 wherein the attachment pin is threaded with self-securing threads.

3. The hinge assembly according to claim 1 wherein the security pin is a cotter key.

4. The hinge assembly according to claim 1 wherein the security pin is a linchpin.

* * * * *